United States Patent [19]

Hanke

[11] Patent Number: 4,869,786

[45] Date of Patent: Sep. 26, 1989

[54] AIR CLASSIFYING PROCESS AND AIR CLASSIFIER

[75] Inventor: Ernst W. Hanke, Beckum, Fed. Rep. of Germany

[73] Assignee: Christian Pfeiffer, Beckum, Fed. Rep. of Germany

[21] Appl. No.: 55,255

[22] Filed: May 29, 1987

[30] Foreign Application Priority Data

Jun. 25, 1986 [DE] Fed. Rep. of Germany ..... 3621221

[51] Int. Cl.[4] ..... B07B 7/083

[52] U.S. Cl. ..... 209/139.2; 209/144; 209/148

[58] Field of Search ..... 209/144, 143, 139.2, 209/148, 150, 140, 141, 142

[56] References Cited

U.S. PATENT DOCUMENTS

| | | | |
|---|---|---|---|
| 1,746,686 | 2/1930 | Sturtevant | 209/139.2 |
| 4,388,183 | 6/1983 | Thomas | 209/139.2 |
| 4,409,097 | 10/1983 | Barthelmess | 209/144 |
| 4,515,686 | 5/1985 | Janich | 209/139.2 |
| 4,551,241 | 11/1985 | Saverse et al. | 209/144 |
| 4,661,244 | 4/1987 | Hanke et al. | 209/144 |

FOREIGN PATENT DOCUMENTS

| | | | |
|---|---|---|---|
| 0023320 | 2/1981 | European Pat. Off. . | |
| 0067895 | 2/1981 | European Pat. Off. . | |
| 0067895 | 1/1985 | European Pat. Off. . | |
| 695328 | 7/1940 | Fed. Rep. of Germany | 209/144 |
| 1507729 | 3/1972 | Fed. Rep. of Germany | 209/139.2 |
| 751450 | 7/1980 | U.S.S.R. | 209/144 |
| 1238816 | 6/1986 | U.S.S.R. | 209/139.2 |
| 219647 | 10/1924 | United Kingdom | 209/139.2 |
| 359763 | 10/1931 | United Kingdom | 209/139.1 |

*Primary Examiner*—Robert B. Reeves
*Assistant Examiner*—Donald T. Hajec
*Attorney, Agent, or Firm*—Fleit, Jacobson, Cohn, Price, Holman & Stern

[57] ABSTRACT

The invention relates to a process and to an air classifier for the separation of classifying material into coarse material and fine material. Known air classifiers suffer from considerable deficiencies with regards to the throughput and the separation efficiency. To avoid this, the invention provides for the performance of a separate reclassification, which takes place in the same way as the pre-classification, whilst incorporating mechanical centrifugal rejection of coarse material particles, particularly through the impact ledges of a centrifuge basket.

11 Claims, 3 Drawing Sheets

AIR CLASSIFYING PROCESS AND AIR CLASSIFIER

BACKGROUND OF THE INVENTION

The present invention relates to a process for the air classification of a grain or particle mixture with reclassifying as well as an air classifier.

Such a process and a corresponding air classifier are known from publication EP 23 320 Al. For separating the fine material particles or fines from the classifying air, this known air classifier generally requires dust separators, e.g. in the form of cyclone separators and filters. The throughput of fines of such a known air classifier is more particularly dependent on the vertical height and the diameter of its centrifuge basket, i.e. its circumferential surface or the cylindrical annular chamber in which classification is performed. The other essential parameter of a classification process, namely the particle size limit differentiating the fine material from the coarse material, is on the one hand determined by the diameter and speed of the centrifuge basket and on the other is dependent on the external diameter of the classifying chamber and the inflow rate of the classifying air into the classifying chamber. In both cases the particle size limit is dependent on the accelerative forces acting on the material being classified.

It is theoretically possible to increase the diameter of the centrifuge basket. However, practical restrictions occur due to the centrifugal forces increasing on a square law basis and the high compressive forces acting on the centrifuge basket ledges. Another aspect acting against the increase in the size of the centrifuge basket diameter is the decrease in curvature of the classifying air paths as the diameter increases. This can admittedly be compensated by higher outflow speed or higher classifying air quantities, but these and the increasing resistance losses would require a higher energy expenditure.

Limits are also placed with regards to the vertical dimensioning of the centrifuge basket due to the mechanical loading of its peripheral ledges. However, an increase in the vertical size of the centrifuge basket is particularly limited due to the occurrence of different flow rates along the basket ledges when classifying air and fines pass between said ledges.

Thus, also in this air classifier, the flow rates along the jacket-like circumferential surface of the centrifuge basket is essentially directly dependent on the suction within the basket. This suction is at a maximum level at the fines outlet from the centrifuge basket and decreases towards the facing, closed end face of said basket. The rotary drive by means of the vertical drive shaft takes place by means of said closed or at least substantially closed end surface in the known air classifier.

These different flow rates when the fines enter the centrifuge basket at different vertical heights thereof lead to differences in the separation quality or selectivity. It is clear that in the vicinity of the classifying air outlet where the maximum suction action occurs, oversize material passes into the fines, whilst at the greatest distance from the classifying air outlet undersize material remains in the coarse material. These serious selectivity disadvantages increase with the magnitude of the vertical extension of the centrifuge basket. However, these disadvantages would appear to be unavoidable in the case of air classifiers with a high throughput capacity. In the case of the air classifier according to EP 23 320 Al, to the aforementioned disadvantage is added that, considered circumferentially, different flow rates would preponderate on the centrifuge basket, because at this point by means of differently designed spiral supply ducts in an approximately tangential arrangement with respect to the centrifuge basket, classifying air quantities of the most varied types, e.g. dust-laden, hot mill spent air and opposite to this, e.g. cooler, but dust-free, atmospheric air are blown into the air classifier.

More particularly in order to overcome the latter disadvantages of different flow rates in the vertical direction along the centrifuge basket, in another known air classifier according to European patent 67 895B1 classifying air outlets are provided on both end faces of the centrifuge basket. However, the problem then occurs that as a result of the considerable vertical extension compared with the centrifuge basket diameter, it is necessary to support and reinforce the basket ledges by a plurality of approximately radially positioned spokes. This is necessary so that it is sufficiently reliably possible to counteract the effects of the operationally occuring centrifugal forces and the other mechanical stresses, such as vibrations. These reinforcing spokes, however, come into contact with the fine material particles contained in the classifying spent air and are therefore subject to relatively high wear. It can be assumed that this known air classifier has been developed for less abrasive classifying material, as is apparent from the upper particle size limit given for it of 2 to 4 μm, in order to obviate this wear problem. As a result of these particle sizes the classifying air removed contains much lower solids concentrations to which the radial spokes are exposed.

Therefore the last-mentioned, known air classifier would not appear to be suitable for a highly abrasive classifying material, such as sintered alumina, quartz sand or cement clinker in the case of solids concentrations of e.g. 800 to 1200 g/m$^3$ in the classifier spent air. Particularly when the material to be classified is a particle mixture having serious abrading characteristics, it is scarcely possible to consider continuous operation over several weeks or months without prolonged shutdowns for repairs or renewal of the centrifuge basket.

On the basis of this prior art, the problem of the present invention is to so design an air classifying process and air classifier for performing it, that the aforementioned disadvantages are avoided and that even in the case of relatively abrasive classifying material a long operating period, in the case of high throughput and improved separation efficiency are achieved, whilst optionally achieving this with a relatively small installation surface for the air classifier.

SUMMARY OF THE INVENTION

Both from the process and apparatus standpoint, an essential basic principle of the present invention is to improve classifying and separation efficiency through performing a multistage classification and, as far as possible, the classifying parameters for each stage are completely adjustable. From the process standpoint this aim is achieved in that in addition to a dispersion of the coarse material resulting from the first process stage, there is a second classification operation by centrifugal rejection. However, the latter is not achieved purely rheologically by introducing classifying air or other gaseous media, but is instead brought about in conjunction with a simultaneous mechanical centrifugal rejection, such as e.g. through the use of a centrifuge basket.

From the apparatus standpoint, a corresponding inventive air classifier is constructed with at least two air classifier stages and the air classifier stage used for reclassifying purposes has an analogue equipment with a centrifuge basket, corresponding basket ledges and one or more coaxial rings of guide vanes, but to bring about a better reclassification generally the dimensions of the second air classifier stage differ from those of the first. Thus, the classifying parameters of the second air classifier stage, in addition to the adjustability of the guide vanes and the inflow rate of the classifying air, can be even more appropriately set to the desired particle sizes and particle size limits.

The inventive process and corresponding apparatus are therefore particularly suitable for upper particle size limits below 10 μm. As corresponding dust separators, such as cyclone separators or filters are required for separating the fines from the classifying air, the small installation surface achieved by the vertical multistage nature of the inventive air classifier is favourable to a use with cyclones. The multistage nature of the air classifier makes it possible to keep the classifier diameter relatively small, so that the inventive air classifier is very well adapted to the use of cyclones as a result of the small surface requirement and in addition the relatively high overall height of the cyclones can be fully utilized. As a result of its multistage nature, the inventive air classifier is suitable for permitting the use of different classifying air quantities with different rheological characteristics, the controlled introduction into the classifying chamber being ensured by the adjustable guide vane rings and the optimization of classification with a view to improved separation efficiency by means of different dimensioning of the following air classifier stage.

Advantageously the air classifier has at least two centrifuge baskets of different axial heights and different diameters. A different provision of ledges with different inclination angles can be provided. The individual centrifuge baskets of the different air classifier stages are appropriately driven separately, e.g. by corresponding telescoped hollow shafts. This permits the fine matching of the mechanical centrifugal rejection of the coarse material to be classified.

Another advantage in connection with reclassification is achieved through constructing the end face of the downstream centrifuge basket facing the upstream air classifier stage as a closed surface, which assumes the function of a whizzer or distribution and dispersion plate respectively. The whizzer for the coarse material from the upstream air classifier stage can also be provided separately with respect to the centrifuge basket. Essential significance is attached to the whizzer function permitting a further dispersing of the already at least once classified coarse material, so that the latter can be introduced in well distributed manner into the following classifying chamber. The centrifuge basket of the second air classifier stage appropriately has a somewhat larger diameter and reduced axial extension as compared with the centrifuge basket of the first air classifier stage. For the same centrifuge basket speed, this permits a mechanical sifting of finer particles of the coarse material due to the higher accelerative forces in the outer area of the centrifuge basket. The reduced axial extension of the second centrifuge basket permits a common suction and removal of the classifying air laden with fines, e.g. upwards in the vicinity of the drive shaft. In the latter embodiment, both end faces of the centrifuge basket of the first air classifier stage are substantially constructed as passages, the centrifuge basket being in driving connection with the shaft by means of a few radial reinforcing webs.

The construction of the air classifier with a closed lower end face of the first centrifuge basket and an open end face of the second centrifuge basket, which is connected to a corresponding suction line, leads to the advantage of better classification, because in this case it is possible to classify and separate three ranges of different particle sizes.

A further advantage can be obtained by vertically spaced air ducts for the classifying air. The air ducts are appropriately constructed as two or multiple-thread spiral casings, which permit a substantially tangential air inlet to the guide vane rings. In the case of multiple-thread spiral casings in a horizontal plane the individual inlets are arranged in equidistantly distributed manner on the circumference, so as to obtain very uniform flow conditions over the entire circumference of the classifying chamber. Due to the vertical separation of the different air ducts for a centrifuge basket, it is possible e.g. in one air duct to blow hot mill spent air on one horizontal plane and onto another, e.g. underlying horizontal plane colder, possibly dust-free atmospheric classifying air. Preferably the colder classifying air is supplied in a lower air duct, so as to cool the classified material. Thus, the possibility exists of permitting the inflow of classifying air with process-based, different flow rates into only a given plane of the centrifuge basket, so that uniform operating conditions exist, when considered over the entire basket circumference.

The inventive air classifier is not limited to the construction with two stages. As a function of the intended use, e.g. for a high degree of cleaning of a coarse material with a given particle size limit, it can be necessary or appropriate to use a further, following third air classifier stage. The removal of the classifying air laden with fines from the third stage appropriately takes place independently of the removal of the classifying air from the preceding stages and in the downwards direction.

Thus, through the possibility of a following multiple classification in an air classifier by means of predispersing air classifier stages it is possible to work with little classifying air, so that the classifier can be constructed with a principal diameter. As a result of the multistage classification, in conjunction with the design of the centrifuge baskets, substantially without radial reinforcing spokes, it is also possible to process relatively wear-unfavourable classifying material.

BRIEF DESCRIPTION OF DRAWINGS

The invention is described in greater detail hereinafter relative to a non-limitative embodiment and the attached drawings, wherein show.

DESCRIPTION OF PREFERRED EMBODIMENT

Figure 1:
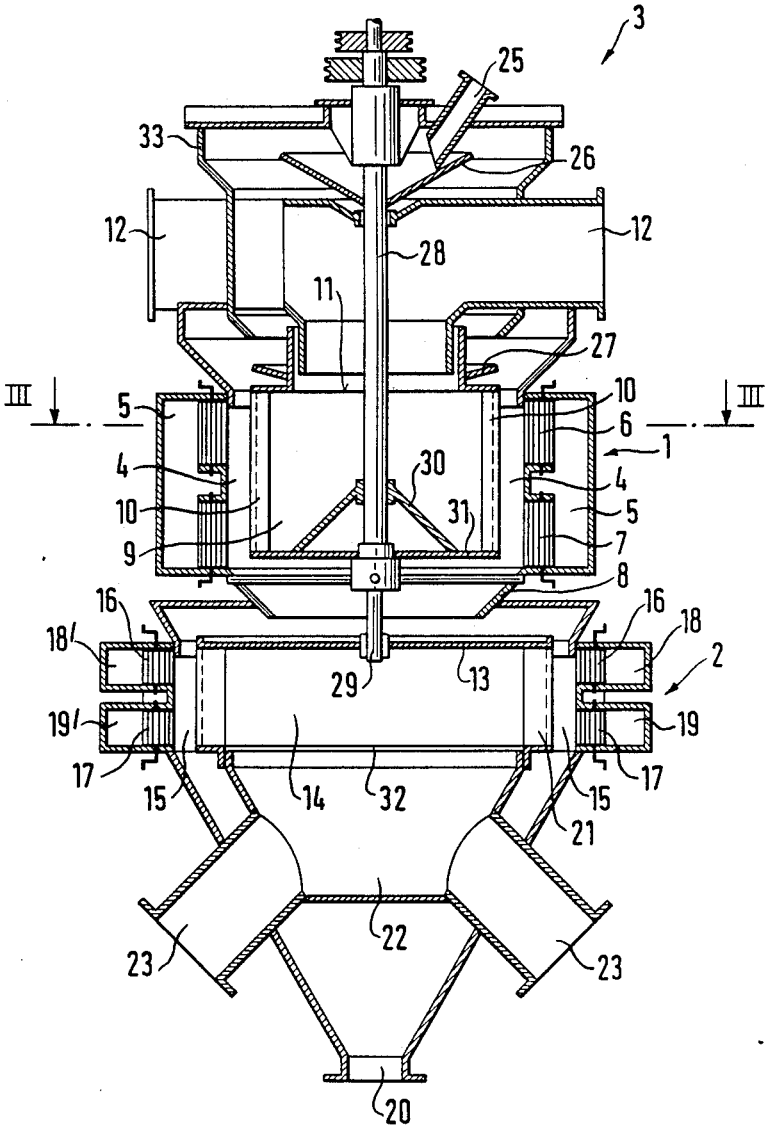
FIG. 1 A vertical section through an air classifier 3 with two stages 1, 2.
Figure 2:
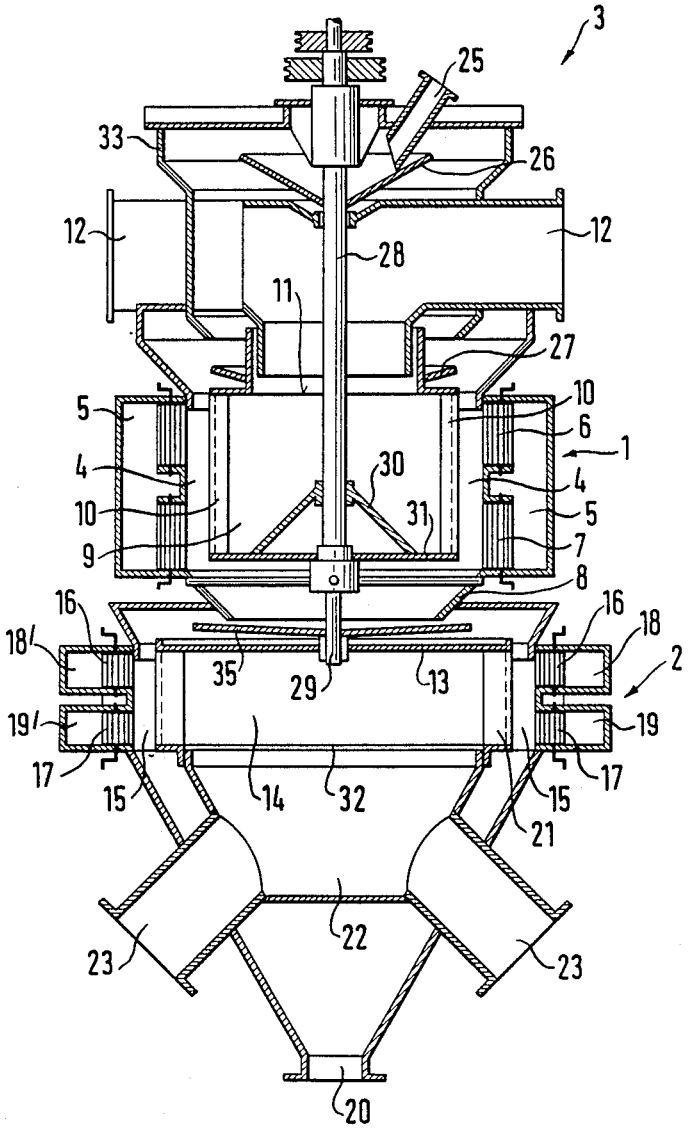
FIG. 2 An embodiment of the air classifier according to FIG. 1, but with a separate whizzer 35 for the second stage 2.
Figure 3:
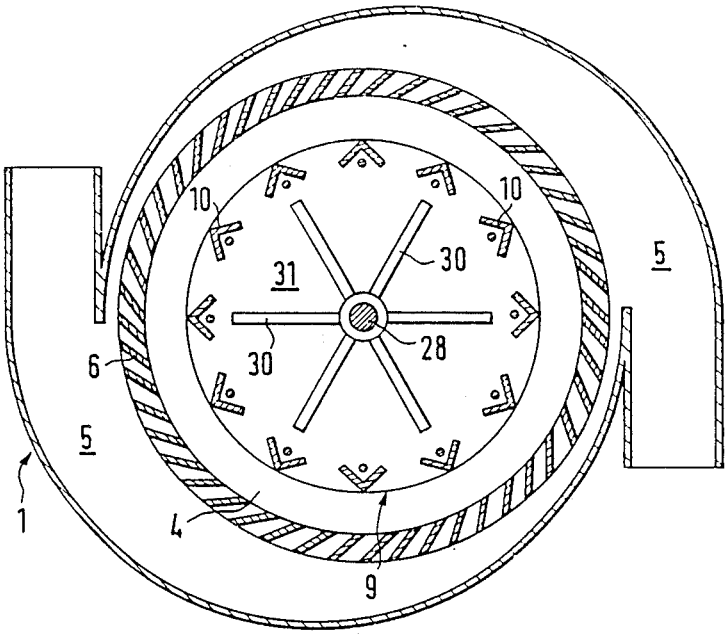
FIG. 3 A sectional view on line III—III of FIG. I.

The material to be classified is fed into air classifier 3 by means of a substantially centrally positioned, upper classifying material inlet 25. The latter projects in sloping manner through the upper casing closure and substantially in the axial region of classifier 3 carries the material to a first whizzer 26, which is conically upwardly open. The classifying material predispersed by this first whizzer 26 passes via two downwardly tapering stages of the casing of air classifier 3 onto a further, second whizzer 27.

By means of whizzer 27, the classifying material passes in well predispersed manner into a first classifying chamber 4 of the first air classifier stage 1. Classifying chamber 4 is circular and cylindrical, being bounded radially outwards by separately adjustable guide vane rings 6, 7, which are arranged in vertically superimposed manner. The outer edges of the impact ledges 10 of the centrifuge basket bound the classifying chamber 4 radially inwards.

The classifying air for the first air classifier stage 1 passes via air ducts 5, which in horizontal section are e.g. constructed as a two-thread spiral casing, into the classifying chamber 4. Due to the classifying air entering the classifying chamber 4 with angular momentum, there is a pre-separation of the classifying material and the air flow flowing from the outside to the inside through classifying chamber 1 accelerates the particles entering the chamber along a spiral path. Thus, as a result of the higher centrifugal forces acting on the coarse material particles are moved out of the spiral path and as a result of gravity fall into the coarse material hopper 8 arranged in the lower region of the first air classifier stage 1.

The fine material particles remaining in the spiral airflow on the first air classifier stage 1 are entrained to the outer circumference of the rotary centrifuge basket 9. Through the rotation of centrifuge basket 9 with its vertically positioned, radially outer impact ledges 10 the particles passing between the ledges are again accelerated and entrained coarse material particles are centrifuged back into classifying chamber 4. The fines led by the classifying air into the interior of centrifuge basket 9 are sucked out to the following dust separators by means of the frontal opening 11 provided in the upper region of centrifuge basket 9 and via a two-thread discharge helix 12 connected thereto.

Centrifuge basket 9 is driven by a drive shaft 28 in the form of a hollow pipe, in which there is a further drive shaft 29 for the centrifuge basket 14 of the second air classifying stage 2. In the present case, in the lower region centrifuge basket 9 has a closed end wall 31, which is roughly centrally guided and reinforced for better stabilization purposes by struts 30 or a wear-resistant cone-shaped shell sloping towards drive shaft 28.

The coarse material leaving the first coarse material hopper 8 passes onto the upper closed end wall 13 of the second centrifuge basket 14 for reclassification purposes. In the present case the centrifuge basket 14 of the second air classifier stage 2 has a smaller vertical extension than the first centrifuge basket 9. However, it has a larger diameter than the first centrifuge basket 9. The second centrifuge basket 14 is driven by means of a second drive shaft 29 guided coaxially in the first drive shaft 28, whilst over the vertical extension there are intermediate mounting supports and struts with the casing of air classifier 3.

The separate drive shaft 29 makes it possible to operate the lower air classifier stage 2 also at a different speed. Centrifuge basket 14 has vertically arranged, radially outer impact ledges 21, which are equidistantly distributed around its circumference. The circular classifying chamber 15 of the second air classifier stage 2 is bounded radially outwards by guide vane rings 16, 17, which are independently adjustable about their vertical axis. Guide vane ring 16 is associated with a separate air duct 18, 18', which in horizontal section has e.g. a multiple-thread design. However, the lower guide vane ring 17 passes with angular momentum into classifying chamber 15, the classifying air flowing in by means of air duct 19, 19'. In the embodiment, the air ducts have an approximately rectangular vertical section, and they may be constructed spirally with a tangential inflow direction in like manner to the air ducts 5 of the first classifying stage.

Air ducts 18, 18' are vertically separated with respect to air ducts 19, 19', which makes it possible to supply said ducts with different classifying air. Thus, e.g. the more wear-resistant air ducts 18, 18' can be used for the supply of hot, particle-laden mill spent air, whereas air ducts 19, 19' can introduce cool atmospheric fresh air into the classifying chamber, so as to again cool the classifying material on this plane.

A reclassification of the coarse material takes place in classifying chamber 15 in the manner described hereinbefore with respect to air classifier stage 1. The coarse material freed from undesired fines falls out of the classifying chamber 15 into the coarse material hopper 20 and is removed downwards. The mixed air from air ducts 18, 18', 19, 19' flows with the desired, residual fines through the impact ledges 21 of the second centrifuge basket 14. These residual fines are sucked together with the mixed air by means of a collecting container 22 connected to the lower open end face 32 of centrifuge basket 14. In the present case, suction takes place by means of two air outlets 23 laterally connected to collecting vessel 22 which supply the fines-laden classifying air to further dust separators.

In the aforementioned concept of air classifier 3 by means of air outlets 12 it is possible to obtain fines with a completely different particle structure to the fines obtained by means of air outlets 23. This process-based production of different particle size distributions for the fines is particularly advantageous for the production of cement powder, so as in this way to improve the concrete characteristics of the cement, such as the time-based strength rise during setting. An improved classification and better separation efficiency for the fines and for the coarse material can also be achieved with the inventive air classifier in that the air quantities supplied to the two classifying chambers 4 and 15 are deliberately varied and have different flow rates.

Thus, the invention leads to the advantage that as a result of the optionally multistage reclassification a higher adjustment precision for the desired particle size limits is obtained, particular improvements resulting from the mechanical cleaning by means of the function of the centrifuge baskets.

I claim:

1. Air classifier with at least one air classifier stage having a centrifuge basket drivable about a substantially vertical rotation axis and said stage having air ducts and radially outwardly positioned ledges through which ledges the classifying air from the air ducts flows from the outside to the inside of the basket, with a circular classifying chamber surrounding the centrifuge basket and a coaxial ring of guide vanes on the outside of the chamber, the classifying air being spirally introducable into the classifying chamber through the guide vanes, with a classifying material inlet above the classifying chamber and an outlet for the classified coarse material below the classifying chamber and with substantially coaxial suction removal for the fines-laden classifying air from the centrifuge basket, characterized in that said one air classifier stage (1), constructed as the upper, first air classifier stage (2) with a centrifuge basket (14) for the reclassification of the coarse material from the first air classifier stage, the centrifuge basket (14) of the second air classifier stage (2) having different dimensions to the centrifuge basket (9) of the upper first air classifier stage (1) and the second classifier stage comprises different vertically separated air ducts (18, 18', 19, 19') from which the classifying air is supplied to the second centrifuge basket.

2. Air classifier according to claim 1, characterized in that there is a whizzer (13) integrated with the following second centrifuge basket (14) by means of which the coarse material of the first air classifier stage (1) is supplied to the circular classifying chamber (15) of the second air classifier stage (2).

3. Air classifier according to claim 1, characterized by means for driving the second centrifuge basket (14) at the same speed as the first centrifuge basket (9).

4. Air classifier according to claim 1, characterized in that the second centrifuge basket (14) has a smaller vertical extension and a larger diameter than the first centrifuge basket (9).

5. Air classifier according to claim 1, characterized by a classifier casing (33) and air ducts (5, 18, 19) for supplying classifying air to one of said classifying chambers (4, 15) the air ducts being constructed spirally with a tangential inflow direction and in the horizontal plane being equidistantly arranged round the circumference of the air classifier casing (33).

6. Air classifier according to claim 1, characterized in that guide vane rings (6, 7; 16, 17) associated with the vertically separated ducts (5, 18, 19) are provided, whose inclination angles are separately adjustable.

7. Air classifier according to claim 1, characterized in that the centrifuge basket (14) of the following second air classifier stage (2) has a central downwards suction removal of the fines with a plurality of lateral suction lines (23).

8. Air classifier according to claim 1, characterized in that in the case of vertically separate air ducts (5, 18, 19) for the following second air classifier stage, cooler classifying air is supplied in one air duct (19) than in the other air duct (5, 18).

9. Air classifier according to claim 1, characterized by means for driving the second centrifuge basket (14) at a different speed compared with the first centrifuge basket (9).

10. Air classifier according to claim 1, characterized in that a separate whizzer is positioned upstream of the second second centrifuge basket (14) for supplying coarse material from the first air classifier stage (1) to the circular classifying chamber (15) of the second air classifier stage (2).

11. Air classifier with at least one air classifier stage having a centrifuge basket drivable about a substantially vertical rotation axis and said stage having air ducts and radially outwardly positioned ledges through which classifying air from the air ducts flows from the outside to the inside of the basket, with a circular classifying chamber surrounding the centrifuge basket, a coaxial ring of guide vanes on the outside of the chamber, the classifying air passing through the guide vanes being spirally introducable into the classifying chamber, a classifying material inlet above the classifying chamber and an outlet for the classified coarse material below the classifying chamber and with substantially coaxial suction removal for the fines-laden classifying air from the centrifuge basket, characterized in that said one air classifier stage (1), constructed as the upper, first air classifier stage (1), is followed by at least one further, second air classifier stage (2) with a centrifuge basket (14) for the reclassification of the coarse material from the first air classifier stage, the centrifuge basket (14) of the second air classifier stage (2) having different dimensions to the centrifuge basket (9) of the upper, first air classifier stage (1), and said second air classifier stage comprising air ducts, which are constructed spirally with a tangential inflow direction for supplying classifying air to the second classifying chamber.

* * * * *